US011352837B1

(12) United States Patent
Ryan

(10) Patent No.: US 11,352,837 B1
(45) Date of Patent: Jun. 7, 2022

(54) PAINT ACCESSORY ATTACHMENT FOR A STEPLADDER

(71) Applicant: Gregory F. Ryan, Dumont, NJ (US)

(72) Inventor: Gregory F. Ryan, Dumont, NJ (US)

( * ) Notice: Subject to any disclaimer, the term of this patent is extended or adjusted under 35 U.S.C. 154(b) by 0 days.

(21) Appl. No.: 17/700,730

(22) Filed: Mar. 22, 2022

Related U.S. Application Data

(60) Provisional application No. 63/164,805, filed on Mar. 23, 2021.

(51) Int. Cl.
*E06C 7/14* (2006.01)

(52) U.S. Cl.
CPC ..... *E06C 7/14* (2013.01)

(58) Field of Classification Search
None
See application file for complete search history.

(56) References Cited

U.S. PATENT DOCUMENTS

| | | | | |
|---|---|---|---|---|
| 4,874,147 | A | 10/1989 | Ory et al. | |
| 5,421,428 | A | 6/1995 | Ingles | |
| 5,511,753 | A | 4/1996 | Lage | |
| 5,782,314 | A | 7/1998 | Zeitler | |
| 5,836,557 | A | 11/1998 | Bailey et al. | |
| 5,913,380 | A | 6/1999 | Gugel et al. | |
| 5,941,344 | A | 8/1999 | Spadaro | |
| 6,443,260 | B1 | 9/2002 | Katz et al. | |
| 7,032,711 | B1 | 4/2006 | Katz et al. | |
| 7,063,187 | B1 | 6/2006 | Lavigne | |
| 7,195,119 | B2 * | 3/2007 | Lungo | E06C 7/14 182/129 |
| 8,579,083 | B2 | 11/2013 | Astor | |
| 8,636,144 | B1 | 1/2014 | Lawery et al. | |
| 10,184,292 | B2 * | 1/2019 | Latimer | E06C 1/18 |
| 10,801,263 | B2 * | 10/2020 | Dangrow | E06C 7/48 |
| 2004/0108164 | A1 | 6/2004 | Pruett et al. | |
| 2004/0217241 | A1 | 11/2004 | Searcy | |
| 2004/0217242 | A1 | 11/2004 | Foreman | |
| 2005/0258002 | A1 | 11/2005 | Sabo | |
| 2005/0274575 | A1 * | 12/2005 | Gibson | E06C 7/14 182/129 |
| 2006/0163003 | A1 * | 7/2006 | Wigstrom | E06C 7/14 182/129 |
| 2006/0169537 | A1 | 8/2006 | Enochs | |
| 2007/0181368 | A1 | 8/2007 | Simpson | |
| 2007/0221802 | A1 | 9/2007 | New, Sr. et al. | |

(Continued)

*Primary Examiner* — Steven M Marsh
(74) *Attorney, Agent, or Firm* — Richard M. Goldberg

(57) ABSTRACT

A paint accessory attachment for a stepladder includes a central housing removably fit over the top shelf of the stepladder, the central housing including an upper wall and inner side walls extending downwardly therefrom; a bottom wall extending outwardly from lower ends of the inner side walls; outer side walls extending upwardly from outer edges of the bottom wall; a circular paint can holding area on the upper wall; spaced apart pairs of vertical outer guide walls at inner surfaces of the outer side walls to form a first slot between each pair; spaced apart pairs of vertical inner guide walls secured to outer surfaces of the inner side walls in alignment with the outer guide walls to form a second slot between each pair, and dividers selectively positioned within selected first and second slots to form adjustable compartments between the inner side walls and the outer side walls.

18 Claims, 6 Drawing Sheets

(56) References Cited

U.S. PATENT DOCUMENTS

| | | | | |
|---|---|---|---|---|
| 2007/0228237 | A1 | 10/2007 | Pochurek | |
| 2008/0121549 | A1 | 5/2008 | Bartok | |
| 2009/0032662 | A1 | 2/2009 | Parrott et al. | |
| 2009/0283361 | A1* | 11/2009 | Gibson | E06C 7/14 182/230 |
| 2011/0272211 | A1 | 11/2011 | Beachy | |
| 2012/0175389 | A1 | 7/2012 | Nook | |
| 2013/0220951 | A1 | 8/2013 | Dufour | |
| 2017/0089135 | A1* | 3/2017 | Heffernan | E04G 5/003 |
| 2018/0187488 | A1* | 7/2018 | Mora | E06C 1/18 |
| 2018/0187489 | A1* | 7/2018 | Parker | E06C 1/14 |
| 2020/0270946 | A1* | 8/2020 | Lawery | B44D 3/125 |

* cited by examiner

PAINT ACCESSORY ATTACHMENT FOR A STEPLADDER

BACKGROUND OF THE INVENTION

The present invention relates generally to a paint accessory attachment for a ladder, and more particularly, is directed to a paint accessory attachment for a stepladder for holding paint cans, paint brushes, drinks, cell phones, drills and other accessories.

Painting using a stepladder can be very difficult. There is the problem of positioning the paint tray and/or paint can on the stepladder for painting. There is the further problem of positioning the brush or roller, as well as any paint accessories, such as tape, screwdrivers, razors, putty knives, etc.

Although various paint attachments are known for use with stepladders, these attachments tend to be very limited in utility, unstable in use and/or complicated and difficult to use. Examples of such attachments are found in U.S. Patent Publication Nos. 2004/0108164, 2004/0217241, 2004/0217242, 2005/0258002, 2006/0169537, 2007/0181368, 2007/0228237, 2007/0221802, 2008/0121549, 2009/0032662, and 2011/0272211, 2012/0175389 and 2013/0220951, and U.S. Pat. Nos. 4,874,147; 5,421,428; 5,511,753; 5,782,314; 5,836,557; 5,913,380; 5,941,344; 6,443,260; 7,032,711; 7,063,187; 8,636,144; and 8,579,083.

SUMMARY OF THE INVENTION

Accordingly, it is an object of the present invention to provide a paint accessory attachment for a stepladder that overcomes the aforementioned problems.

It is another object of the present invention to provide a paint accessory attachment for a stepladder that easily and positively locates the paint tray attachment to the stepladder in an easy and secure manner.

It is still another object of the present invention to provide a paint accessory attachment for a stepladder that provides for the stable mounting of different size paint cans thereto.

It is yet another object of the present invention to provide a paint accessory attachment for a stepladder that includes a removable brush well for holding a wet paintbrush.

It is a further object of the present invention to provide a paint accessory attachment for a stepladder that provides for the mounting of tools such as an electric drill.

It is a still further object of the present invention to provide a paint accessory attachment for a stepladder that provides for adjustable size compartments for the storing of paint accessories, such as tape, screwdrivers, razors, putty knives, screws, bolts, etc.

It is another object of the present invention to provide a paint accessory attachment for a stepladder for holding non-paint accessories such as a cell phone, a coffee cup, etc.

It is still another object of the present invention to provide a paint accessory attachment for a stepladder that is easy and economical to use and manufacture.

In accordance with an aspect of the present invention, a paint accessory attachment for a stepladder having a top shelf, includes a central housing adapted to removably fit over the top shelf of the stepladder, the central housing including an upper wall which seats above the top shelf and inner side walls extending downwardly from the upper wall in surrounding relation to the top shelf; a bottom wall which extends outwardly from lower ends of at least some of the inner side walls; and outer side walls extending upwardly from outer edges of the bottom wall in opposing relation to the inner side walls. A circular area is provided on the upper surface of the upper wall for removably holding a paint can thereon such that the paint can is positioned over the top shelf. A compartment forming arrangement includes spaced apart pairs of parallel, vertically oriented, outer guide walls secured to inner surfaces of the outer side walls so as to form a first slot between the outer guide walls of each pair, spaced apart pairs of parallel, vertically oriented, inner guide walls secured to outer surfaces of the inner side walls in alignment with the outer guide walls so as to form a second slot between the inner guide walls of each pair, and a plurality of dividers adapted to be selectively positioned within selected first and second aligned slots to form adjustable compartments between the inner side walls and the outer side walls.

A lower end of one inner side wall is connected directly to a lower end of one outer side wall.

The upper wall includes finger openings for a person to grasp and hold the paint accessory attachment. The finger openings are provided within the circular area.

Opposite ones of the outer side walls having at least one set of aligned notches for receiving pipes therein extending across the paint accessory attachment. Preferably, there are two sets of the aligned notches, with one set have a greater dimension than the other set to accommodate different size pipes therein.

In another embodiment, there are two arcuate walls on the upper surface in surrounding relation to the circular area, the arcuate walls having aligned recesses in upper surfaces thereof for receiving pipes therein extending across the paint accessory attachment. Preferably, adjacent recesses have different sizes to accommodate different size pipes therein.

The circular area is defined by a circular raised surface on the upper surface of the upper wall. There is a circular recess within the circular raised surface for removably holding a smaller paint can thereon such that the paint can is positioned over the top shelf.

There is also a recess in the upper surface for holding various loose items.

A housing is secured to the paint accessory attachment between one inner side wall and one outer side wall for holding a paint brush. The upper end of the housing includes a notch for receiving a handle of the paint brush.

There is another housing secured to the paint accessory attachment between one inner side wall and one outer side wall for holding at least one of the following: a cell phone, pencils, pens or markers.

Preferably, there is a raised circular lip on the bottom wall for holding one of a coffee cup or soda can.

There is also at least one through opening in the bottom wall for receiving one of a screwdriver or hammer.

In addition, the upper end of one outer side wall includes a cutout for receiving a handle of a drill with a drill bit attached to the drill adapted to extend through a respective through opening in the bottom wall.

In accordance with an aspect of the present invention, a paint accessory attachment for a stepladder having a top shelf, including a central housing adapted to removably fit over the top shelf of the stepladder, the central housing including an upper wall which seats above the top shelf and inner side walls extending downwardly from the upper wall in surrounding relation to the top shelf; a bottom wall which extends outwardly from lower ends of at least some of the inner side walls; and outer side walls extending upwardly at from outer edges of the bottom wall in opposing relation to the inner side walls. A circular area is provided on the upper surface of the upper wall for removably holding a paint can thereon such that the paint can is positioned over the top shelf. There are a plurality of spaced apart dividers extending between and secured to the inner and outer side walls to form compartments between the inner side walls and the outer side walls.

The above and other features of the invention will become readily apparent from the following detailed description thereof which is to be read in connection with the accompanying drawings.

DETAILED DESCRIPTION

Figure 1:
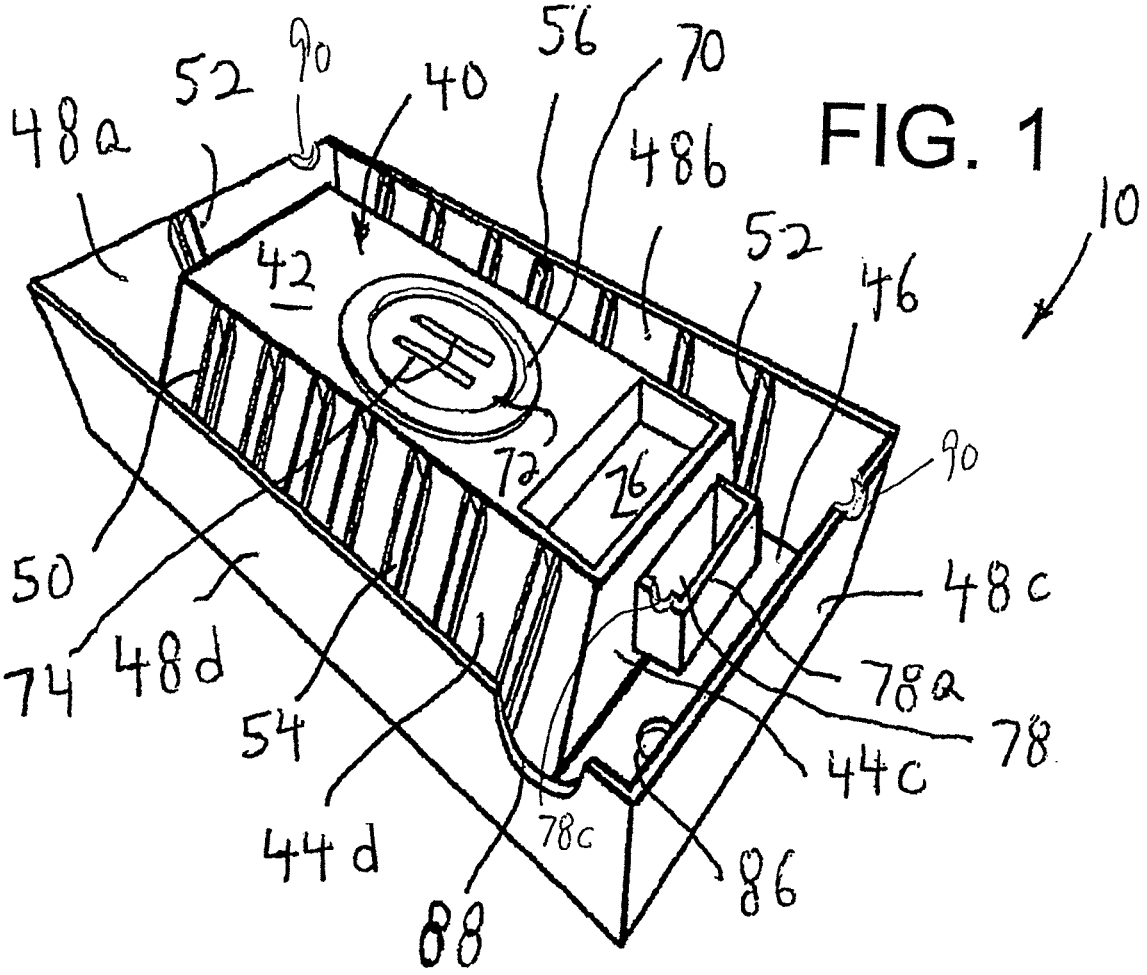
FIG. 1 is a top perspective view of a paint accessory attachment according to the present invention.
Figure 2:
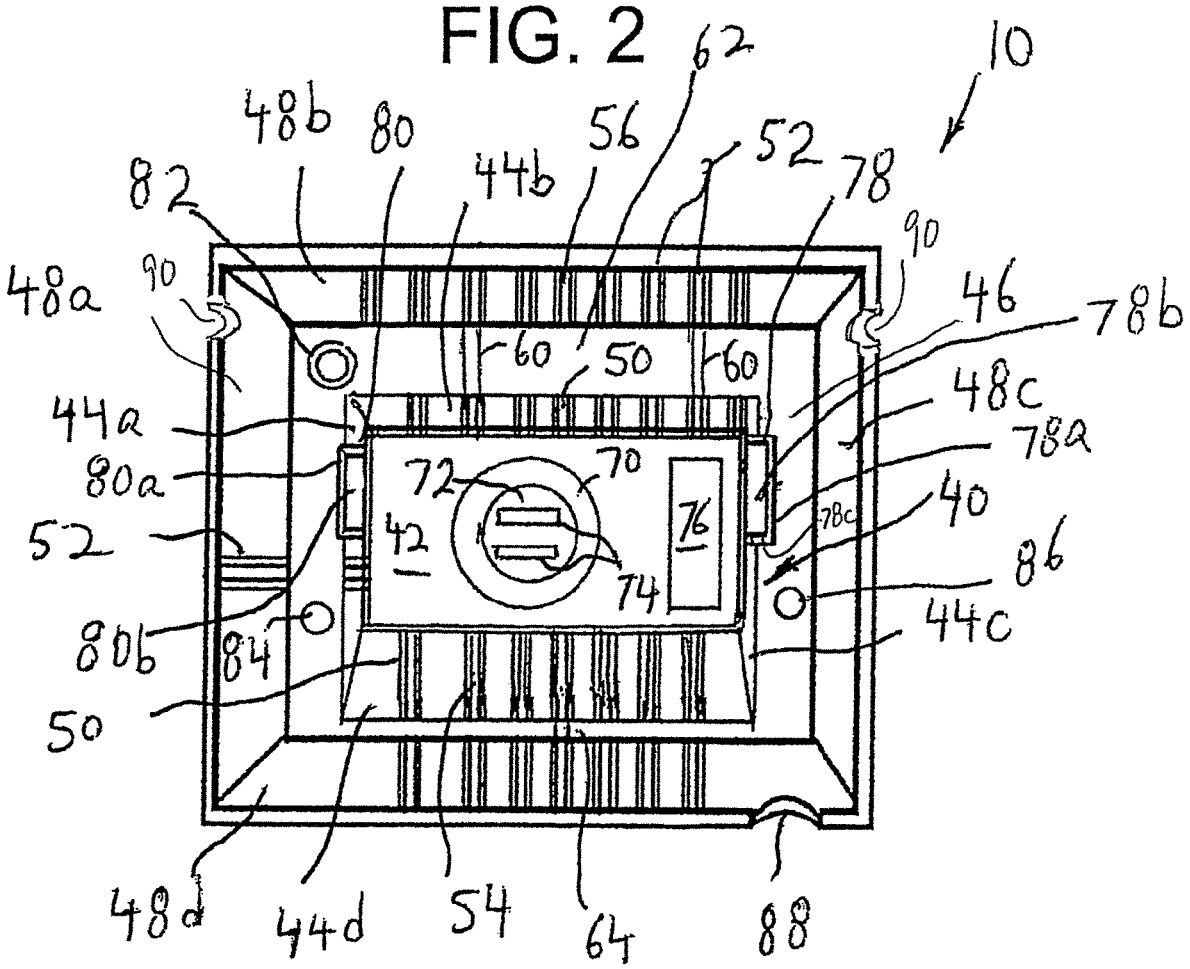
FIG. 2 is a top plan view of the paint accessory attachment.
Figure 3:
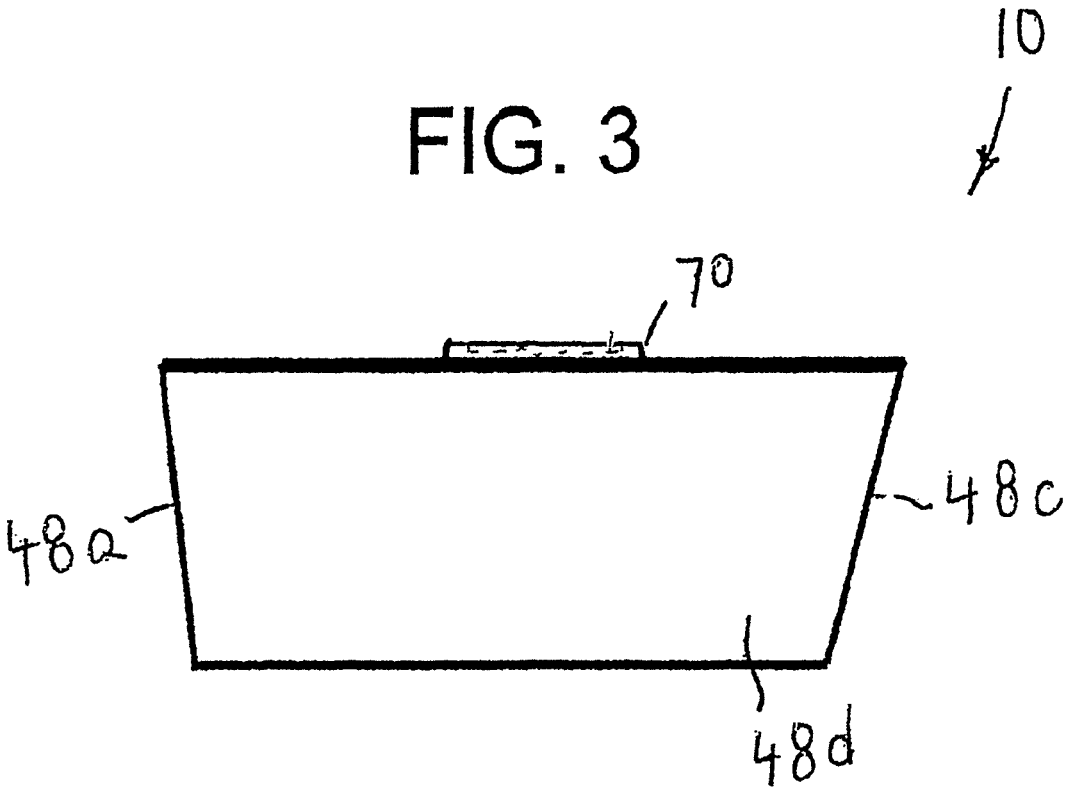
FIG. 3 is a side elevational view of the paint accessory attachment.
Figure 5:
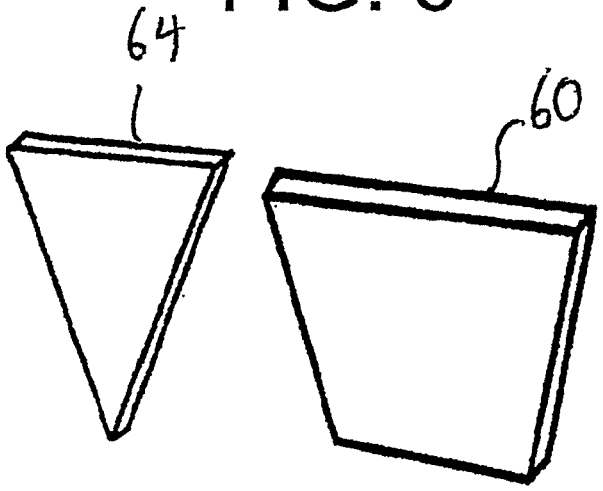
FIG. 5 is a perspective view of the dividers for use with the paint accessory attachment.
Figure 4:
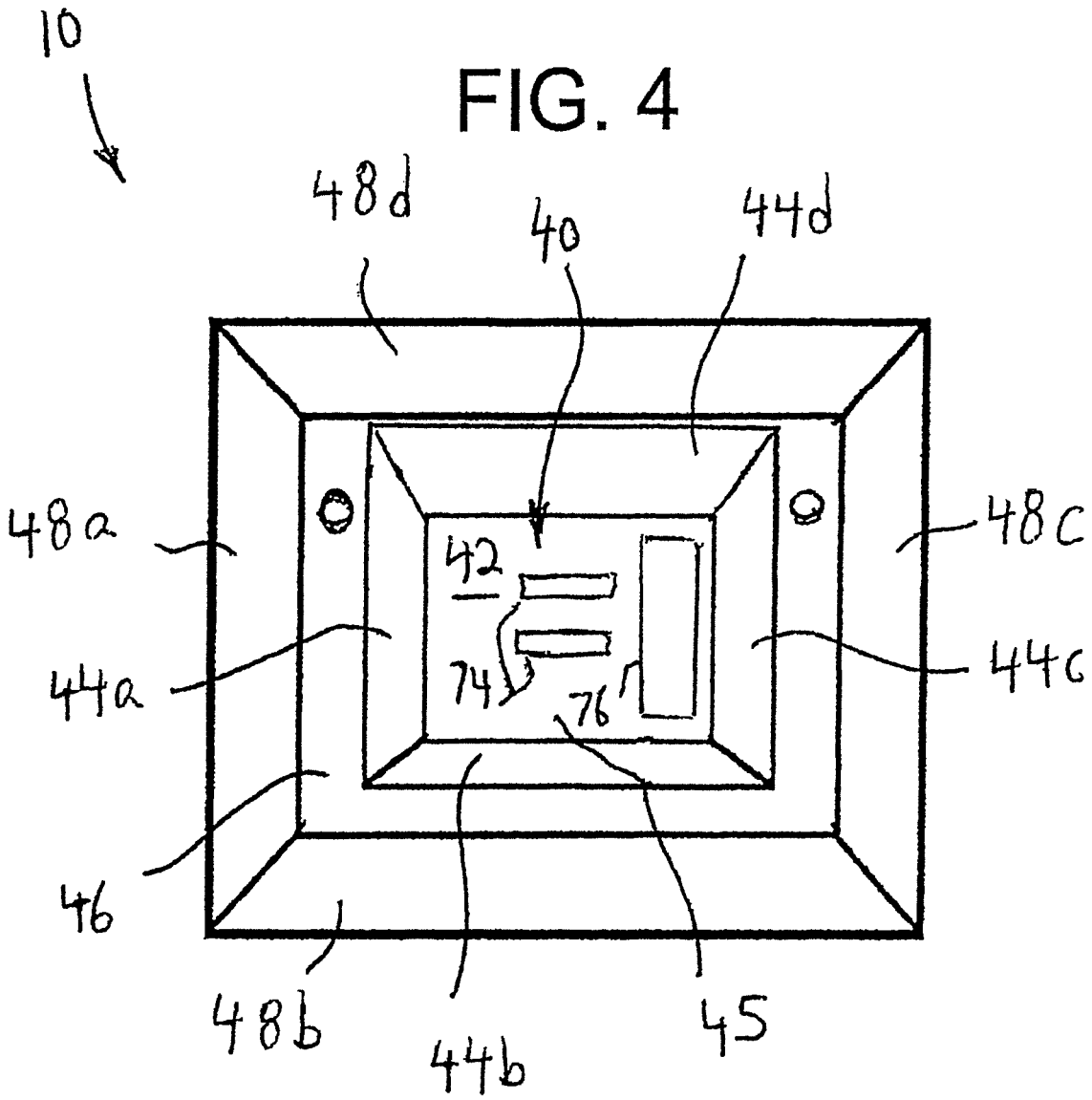
FIG. 4 is a bottom plan view of the paint accessory attachment.
Figure 6:
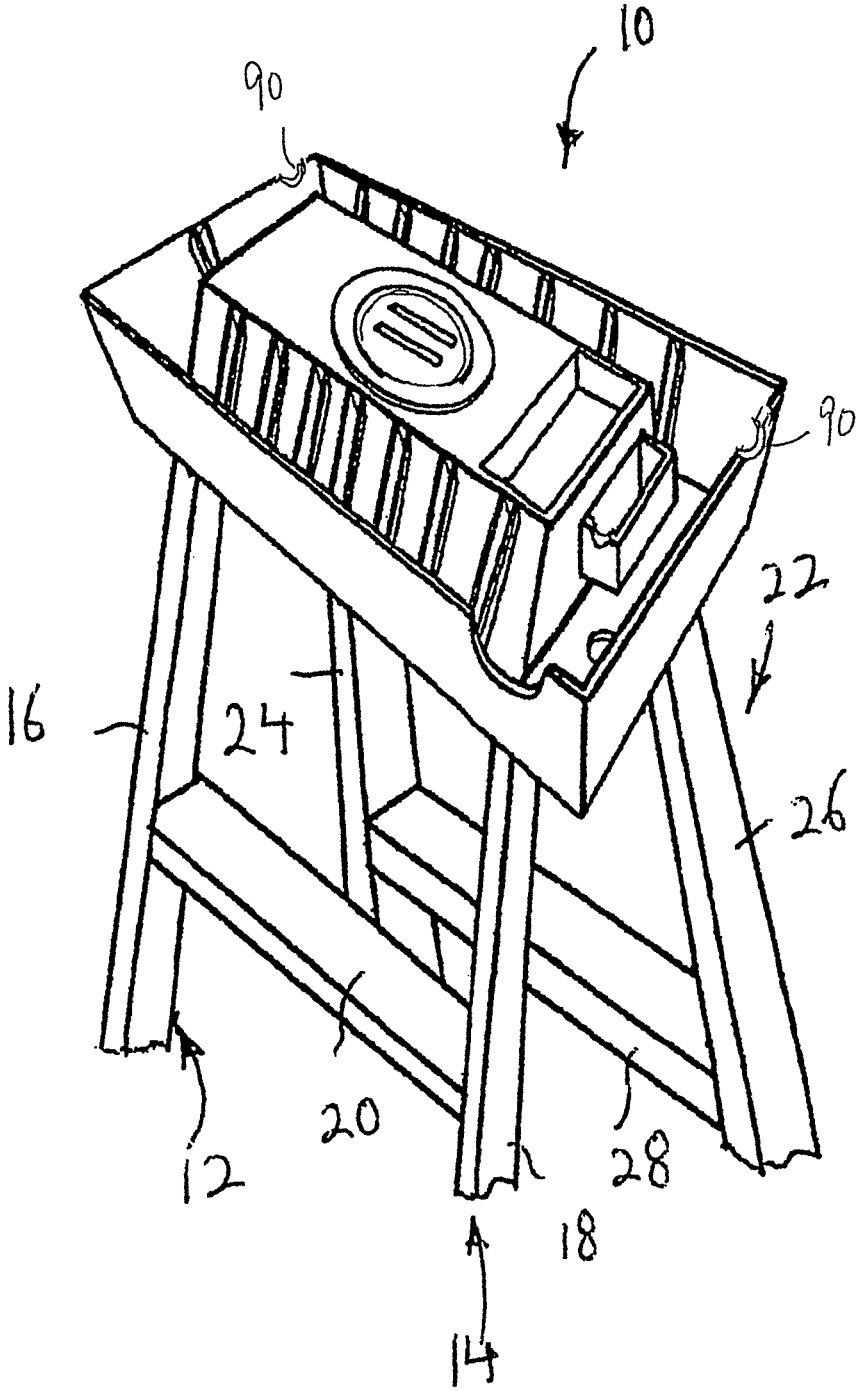
FIG. 6 is a top perspective view of the paint accessory attachment according to the present invention mounted on a stepladder.

Referring to the drawings in detail, a paint accessory attachment 10 is provided for removable, secure mounting on a stepladder 12. Stepladder 12 is a conventional stepladder having a front section 14 formed by a left front rail 16 and a right front rail 18 in parallel and spaced relation with each other and connected together by a plurality of parallel, vertically spaced apart steps or rungs 20. Stepladder 12 further comprises a rear section 22 having a left rear rail 24 and a right rear rail 26 in parallel and spaced relation with each other, and connected together by a plurality of parallel, vertically spaced apart cross-pieces or steps 28. Stepladder 12 comprises a top shelf (not shown), as is conventional, to which front section 14 and rear section 22 are connected. Specifically, the upper ends of rails 16 and 18 are fixed to respective opposite sides of the top shelf by rivets, while the upper ends of rails 24 and 26 of rear section 22 are pivotally connected to respective opposite sides of the top shelf. As a result, rear section 22 can be pivoted to a closed position immediately adjacent to front section 14, or to an open position away from front section 14 so as to form an A-frame or inverted V-shape. The above is a conventional construction of a stepladder.

Paint accessory attachment 10 is preferably formed of a plastic material in an injection molded process and includes a central housing 40 which seats upon and is supported by the top shelf. Central housing 40 includes a top wall 42 of a generally rectangular configuration having four sides, and four side walls 44*a*-44*d* which extend downwardly from top wall 42 at an angle slightly greater than 90 degrees. Preferably, inner side walls 44*a*, 44*b* and 44*c* along the shorter sides and one longer side extend downwardly at a smaller angle from top wall 40 than inner side wall 44*d*.

As a result, a cavity 45 is provided at the underside of attachment 10 and defined by the inner surfaces of inner side walls 44*a*-44*d* and the lower surface of top wall 42, for receiving the top shelf of the stepladder therein. In such case, top wall 42 seats on the top shelf, and inner side walls 44*a*-44*d* retain attachment 10 on the top shelf in a stable manner.

As a result of the present invention, the inner side walls 44*a*-44*d* actually wedge themselves around the top shelf, forming a lock with the top shelf without any clamps or other securing means.

It will therefore be appreciated that the present invention does not require any clamps or other securing means to secure the paint accessory attachment to the top shelf of the stepladder. This is because the center of gravity is positioned at all times directly above the top shelf and because of the aforementioned wedging action.

A bottom wall 46 extends outwardly from the lower ends of inner side walls 44*a*-44*c* so as to be in parallel, spaced apart relation with respect to top wall 40.

Outer side walls 48*a*-48*c* extend upwardly at an angle slightly greater than 90 degrees from the outer edges of bottom wall 46 in opposition to inner side walls 44*a*-44*c*. A fourth outer side wall 48*d* extends upwardly and outwardly at an angle from the lower edge of inner side wall 44*d*, so as to provide a V-shape in cross-section therewith.

The outer surfaces of inner side walls 44*a*-44*d* have spaced apart pairs of parallel guide walls 50 secured thereto along the vertical direction, and the inner surfaces of outer side walls 48*a*-48*d* have spaced apart pairs of parallel guide walls 52 secured thereto along the vertical direction. It will be appreciated that each pair of parallel guide walls 50 defines a guiding slot 54 therebetween and each pair of parallel guide walls 52 defines a guiding slot 56 therebetween. Guide walls 50 and 52 are arranged in opposing relation to each other so that guiding slots 54 and 56 are coplanar.

A plurality of first dividers 60 can be adjustably positioned within selected guiding slots 54 and 56 of inner side walls 44*a*-44*c* and outer side walls 48*a*-48*c*. Specifically, as shown, each divider 60 is of a generally trapezoidal shape such that the bottom edge thereof seats on bottom wall 46 and the side edges thereof fit within guiding slots 54 and 56, so as to separate the area between inner side walls 44*a*-44*c* and outer side walls 48*a*-48*c* into compartments 62. It will be appreciated that dividers 60 can be selectively inserted into different guiding slots 54 and 56 to vary the size of each compartment 62.

A plurality of second dividers 64 can be adjustably positioned within selected guiding slots 54 and 56 of inner side wall 44*d* and outer side wall 48*d*. Specifically, as shown, each divider 64 is of a generally triangular shape with the two side edges thereof fitting within selected guiding slots 54 and 56 of inner side wall 44*d* and outer side wall 48*d*.

Alternatively, dividers 60 and 64 can be manufactured to be permanently set at different positions.

In addition, the upper surface of top wall 42 is provided with a first circular raised surface 70 thereon and a second circular recess 72 of a smaller diameter than first circular raised surface 70 and positioned within first circular raised surface 70. Circular raised surface 70 is of a very small height, and provides for the secure positioning of a paint can on top surface 42. In such case, the lower lip of larger paint cans would seat around first circular raised surface 70, while the lower lip of smaller paint cans would seat within second circular recess 72.

Further, two parallel elongated openings 74 are provided in second circular recess 72 in order to allow the fingers of a person to pull up and remove attachment 10 from a stepladder.

A rectangular recess 76 is provided at one end of top wall 42 in order to hold various loose items such as screws, bolts, keys, etc.

The outer surface of inner side wall 44*c* includes a housing 78 extending outwardly therefrom and open at its upper end 78*a*, but closed by a bottom wall 78*b*, for holding a wet paintbrush. At the upper end of one side wall thereof, there is a notch 78*c* in which a paintbrush handle can rest.

The outer surface of the opposite inner side wall 44*a* includes a housing 80 extending outwardly therefrom and open at its upper end 80*a*, but closed by a bottom wall 80*b*, for holding a cell phone, pencils, markers, etc.

A raised circular lip 82 is provided on the upper surface of bottom wall 46 for holding a coffee cup or soda can, with the lip thereof being positioned around raised circular lip 82.

Two openings 84 and 86 are provided in bottom wall 46 for holding screwdrivers or hammers.

The upper edge of outer side wall 48*d* adjacent outer side wall 48*a*, includes a semicircular cutout 88 for receiving a handle of an electric drill with the drill bit thereof adapted to extend through opening 86 and the handle cradled within semicircular cutout 88.

Lastly, the upper edges of outer side walls 48*a* and 48*c*, closer to outer side wall 48*b*, each include a cut-out or notch 90 for holding a pipe, 2×4 piece of wood, curtain rods, etc. which would be balanced on the ladder and would extend past the outer side walls 48*a* and 48*c*.

Figure 7:
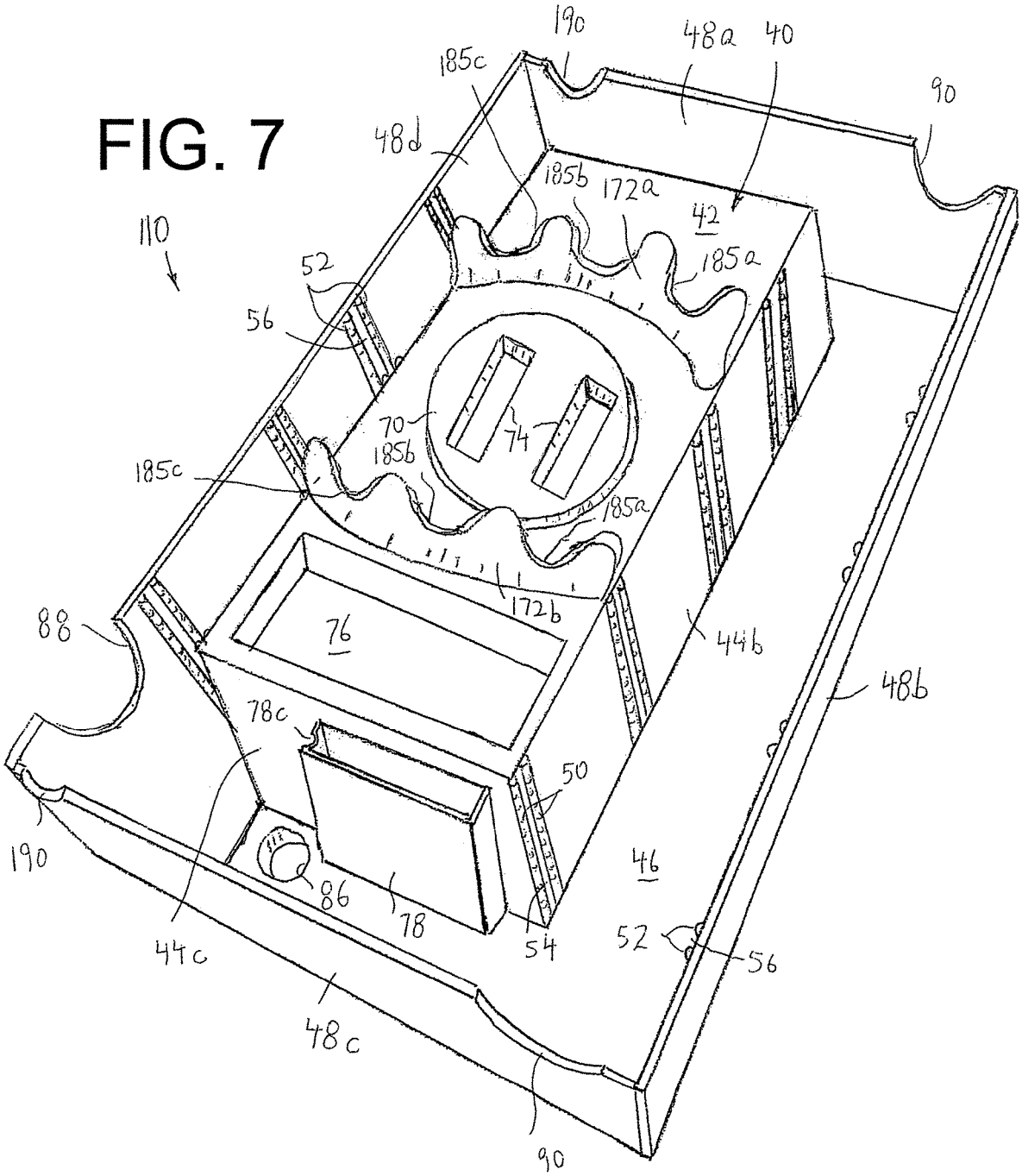
FIG. 7 is a top perspective view of a paint accessory attachment according to another embodiment of the present invention.

Referring now to FIG. 7, there is shown a paint accessory attachment 110 according to a modified version of the present invention in which the same numerals used in the first embodiment are shown in the modified embodiment.

Paint accessory attachment 110 is identical to paint accessory attachment 10, except as follows.

Specifically, the upper edges of outer side walls 48*a* and 48*c*, closer to outer side wall 48*d*, each include a cut-out or notch 190 for holding a pipe, 2×4 piece of wood, curtain rods, etc. which would be balanced on the ladder and would extend past the outer side walls 48*a* and 48*c*. It will be appreciated that the diameter of notch 190 is smaller than that of notch 90, for holding a smaller diameter pipe, etc.

In place of second circular recess 72, first circular raised surface 70 is made smaller to hold a smaller paint can, and two opposing arcuate raised walls 172*a* and 172*b* are provided in slightly spaced, surrounding relation to first circular raised surface 70. The upper edge of each arcuate raised wall 172*a* and 172*b* is provided with a plurality of spaced apart arcuate recesses 185*a*, 185*b* and 185*c*, with recesses 185*a* of arcuate raised walls 172*a* and 172*b* being in alignment, recesses 185*b* of arcuate raised walls 172*a* and 172*b* being in alignment and recesses 185*c* of arcuate raised walls 172*a* and 172*b* being in alignment. Each set of aligned recesses 185*a*, 185*a*; 185*b*, 185*b*; and 185*c*, 185*c* is adapted to hold a pipe or the like lengthwise thereacross. Further, recesses 185*a*, 185*b* and 185*c* can have different diameters to hold different size pipes.

It will be appreciated that arcuate raised walls 172*a* and 172*b* function to restrain a larger paint can therebetween.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention.

What is claimed is:

1. A paint accessory attachment for a stepladder having a top shelf, comprising:

a central housing adapted to removably fit over the top shelf of the stepladder, the central housing including an upper wall which seats above the top shelf and inner side walls extending downwardly from the upper wall in surrounding relation to the top shelf;

a bottom wall which extends outwardly from lower ends of at least some of the inner side walls;

outer side walls extending upwardly from outer edges of the bottom wall in opposing relation to the inner side walls;

a circular area on the upper surface of the upper wall for removably holding a paint can thereon such that the paint can is positioned over the top shelf; and a compartment forming arrangement comprising:

spaced apart pairs of parallel, vertically oriented, outer guide walls secured to inner surfaces of the outer side walls so as to form a first slot between the outer guide walls of each pair, spaced apart pairs of parallel, vertically oriented, inner guide walls secured to outer surfaces of the inner side walls in alignment with the outer guide walls so as to form a second slot between the inner guide walls of each pair, and a plurality of dividers adapted to be selectively positioned within selected first and second aligned slots to form adjustable compartments between the inner side walls and the outer side walls.

2. A paint accessory attachment according to claim 1, wherein a lower end of one said inner side wall is connected directly to a lower end of one said outer side wall.

3. A paint accessory attachment according to claim 1, wherein said upper wall includes finger openings for a person to grasp and hold said paint accessory attachment.

4. A paint accessory attachment according to claim 3, wherein said finger openings are provided within said circular area.

5. A paint accessory attachment according to claim 1, wherein opposite ones of said outer side walls having at least one set of aligned notches for receiving pipes therein extending across said paint accessory attachment.

6. A paint accessory attachment according to claim 5, wherein there are two sets of said aligned notches, with one set having a greater dimension than the other set to accommodate different size pipes therein.

7. A paint accessory attachment according to claim 1, further including two arcuate walls on said upper surface in surrounding relation to said circular area, said arcuate walls having aligned recesses in upper surfaces thereof for receiving pipes therein extending across said paint accessory attachment.

8. A paint accessory attachment according to claim 7, wherein adjacent said recesses having different sizes to accommodate different size pipes therein.

9. A paint accessory attachment according to claim 1, wherein the circular area is defined by a circular raised surface on the upper surface of the upper wall.

10. A paint accessory attachment according to claim 9, further including a circular recess within the circular raised surface for removably holding a smaller paint can thereon such that the paint can is positioned over the top shelf.

11. A paint accessory attachment according to claim 1, further including a recess in said upper surface for holding various loose items.

12. A paint accessory attachment according to claim 1, further including a housing secured to said paint accessory attachment between one said inner side wall and one said outer side wall for holding a paint brush.

13. A paint accessory attachment according to claim 12, wherein an upper end of said housing includes a notch for receiving a handle of the paint brush.

14. A paint accessory attachment according to claim 1, further including a housing secured to said paint accessory attachment between one said inner side wall and one said outer side wall for holding at least one of the following:

a cell phone, pencils, pens or markers.

15. A paint accessory attachment according to claim 1, further including a raised circular lip on the bottom wall for holding one of a coffee cup or soda can.

16. A paint accessory attachment according to claim 1, further including at least one through opening in the bottom wall for receiving one of a screwdriver or hammer.

17. A paint accessory attachment according to claim 16, wherein the upper end of one said outer side wall includes a cutout for receiving a handle of a drill with a drill bit attached to the drill adapted to extend through a respective said through opening in the bottom wall.

18. A paint accessory attachment for a stepladder having a top shelf, comprising:

a central housing adapted to removably fit over the top shelf of the stepladder, the central housing including an upper wall which seats above the top shelf and inner side walls extending downwardly from the upper wall in surrounding relation to the top shelf;

a bottom wall which extends outwardly from lower ends of at least some of the inner side walls;

outer side walls extending upwardly at from outer edges of the bottom wall in opposing relation to the inner side walls;

a circular area on the upper surface of the upper wall for removably holding a paint can thereon such that the paint can is positioned over the top shelf; and a plurality of spaced apart dividers extending between and secured to said inner and outer side walls to form compartments between the inner side walls and the outer side walls.

* * * * *